US008512522B2

(12) United States Patent
Brody et al.

(10) Patent No.: US 8,512,522 B2
(45) Date of Patent: Aug. 20, 2013

(54) METHOD OF PRODUCING PAPER WITH METHANE REDUCTION INGREDIENTS

(76) Inventors: Spencer S. Brody, Metuchen, NJ (US); Brian Davis, Milltown, NJ (US)

( * ) Notice: Subject to any disclaimer, the term of this patent is extended or adjusted under 35 U.S.C. 154(b) by 0 days.

(21) Appl. No.: 13/347,497

(22) Filed: Jan. 10, 2012

(65) Prior Publication Data

US 2012/0227921 A1 Sep. 13, 2012

Related U.S. Application Data

(60) Provisional application No. 61/431,149, filed on Jan. 10, 2011.

(51) Int. Cl.
*D21H 17/66* (2006.01)

(52) U.S. Cl.
USPC ..... 162/181.2; 162/181.1

(58) Field of Classification Search
None
See application file for complete search history.

(56) References Cited

U.S. PATENT DOCUMENTS

| | | | | |
|---|---|---|---|---|
| 4,189,345 | A * | 2/1980 | Foster et al. | 162/168.1 |
| 4,377,612 | A * | 3/1983 | Serlin et al. | 428/212 |
| 5,904,808 | A * | 5/1999 | Gelman et al. | 162/7 |
| 2006/0289355 | A1 * | 12/2006 | Hansen et al. | 210/603 |
| 2009/0232995 | A1 * | 9/2009 | Brody et al. | 427/419.8 |

* cited by examiner

*Primary Examiner* — Richard Crispino
*Assistant Examiner* — Eric Yaary
(74) *Attorney, Agent, or Firm* — Robert L. Shaver; Dykas & Shaver

(57) ABSTRACT

Disclosed is a formulation and method for treating paper so that paper in landfills produces less methane than untreated paper. The method includes adding one or more nitrate salts to paper during the process of making paper, or after the paper is made. One effect of adding the nitrate salts is promoting the growth of certain bacteria which do not produce methane as they consume paper products.

4 Claims, 3 Drawing Sheets

METHOD OF PRODUCING PAPER WITH METHANE REDUCTION INGREDIENTS

PRIORITY/CROSS-REFERENCE TO RELATED APPLICATIONS

This application claims the benefit of U.S. Provisional Application No. 61/431,149, filed Jan. 10, 2011, the disclosure of which is incorporated by reference.

TECHNICAL FIELD

The presently disclosed and claimed inventive concept(s) generally relates to a method for reducing methane production in a landfill, and more particularly to a method for treating paper to reduce methane production when the paper is disposed.

BACKGROUND

Methane and Global Warming.

Until recently the general public associated the problem of global warming mainly with the build up of carbon dioxide in the atmosphere. Climate researchers have known for years that other gases are also involved, and that some of these have more heat-trapping capability than carbon dioxide. Methane is a prominent example. A molecule of methane has twenty-one times the heat-trapping capacity of a molecule of carbon dioxide (EPA, 2010). In recent years the general public has become more aware of the impact of methane, based on the publication of articles in a number of popular publications, including The New York Times (Kaufmann, 2009) and the websites of Scientific American (Mims, 2010) and Time (Walsh, 2010)

Methanogens.

Methane usually originates from the activity of specialized microorganisms, called methanogens, which degrade organic matter in the absence of oxygen. Cattle rumens, landfills and swamplands are the primary habitats of methanogens. Environmental Protection Agency (EPA, 2010) figures indicate that only enteric fermentation (i.e., digestive processes of ruminant animals) produces more methane emissions in the United States than landfills.

Inhibition of Methanogenesis.

Methanogens are not the only specialized microbes in the environment which can degrade organic matter in the absence of oxygen. They have to compete with several other types of microbes to gain access to the compounds which they need to generate energy, and methane. These other microbes can generate energy more efficiently than methanogens can, and they do so without producing methane. When the key nutrients required by these other groups are present, they will outcompete the methanogens, and methane output will be low. Thus, environments containing nitrate, sulfate, manganese (IV) or ferric ions generally do not support extensive formation of methane (Konhauser, 2007).

An example of the importance of competing modes of metabolism can be seen in the effect of the sulfate ion. Sulfate is an important inhibitor of methanogenesis. A metabolic class of microbes known as the sulfate-reducing bacteria (SRB) are abundant in the environment, and wherever sulfate is present in an anaerobic environment they will efficiently metabolize it and out-compete the methanogens. Quantities of sulfate are low in most freshwater sediments. As a result, SRBs are largely inactive, and methanogenesis can take place unimpeded.

On the other hand, marine sediments contain high levels of sulfate, SRBs are very active, and methanogenesis is strongly inhibited. The presence of sulfates in wetlands has major implications for the global climate. Gauci et al. (2004) concluded that man-made sulfur pollution has reduced the formation of methane in wetlands by about 8% worldwide, compared to the total that would have been formed in the absence of the sulfur pollution.

In addition to the SRBs, methanogens must also compete with microorganisms capable of producing energy by reducing nitrate, manganese or iron (Konhauser, 2007). When any of these other microorganisms have access to their essential nutrients, they are likely to out-compete the methanogens, and methane formation will be severely limited.

SUMMARY OF THE DISCLOSURE

Paper constitutes about one-third of municipal solid waste (MSW), making it the largest fraction of material in MSW (EPA, 2008), and the largest biodegradable component. The cellulosic fraction of paper is readily broken down in landfills, leading to the generation of carbon dioxide and methane. This process has been identified by the Environmental Protection Administration as a significant source of landfill methane (EPA, 2010). The invention is intended to treat paper so that when the paper is degraded under anaerobic conditions, the invention will supply key nutrients required by the competitors of the methanogens. This will stimulate growth of the competitors at the expense of the methanogens, resulting in much lower formation of methane.

Various formulae of the invention have been the subject of two series of laboratory testing. Methane was significantly inhibited in both studies.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept(s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DEFINITIONS

Detailed Description of the Exemplary Embodiments

Figure 1:
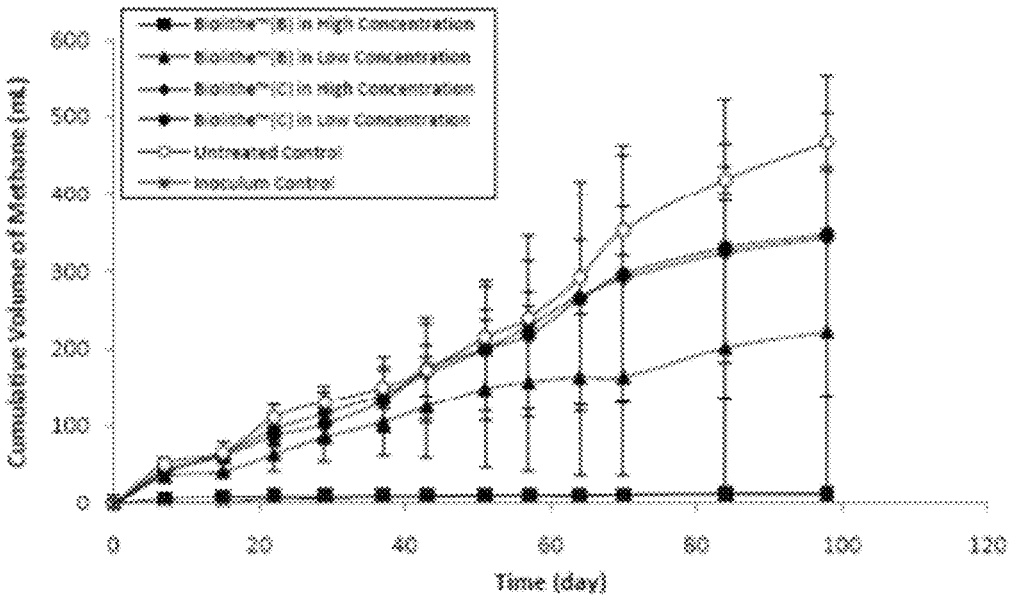
FIG. 1 is a chart of methane volumes from untreated and treated paper.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Paper in Microcosms.

In the laboratory multiple small anaerobic environments can be established in individual bioreactors known as microcosms. Using formulae which we provided, microcosms were set up microcosms (delete) in which treated paper served as the main carbon source for anaerobic microbes. Both the evolution of methane and, by analysis of DNA, changes in the microbial communities which were present were studied. The researcher concluded (Chen, 2010):

"Taken together, the results of all tests indicate that (the invention) could effectively control paper degradation in relatively high amounts. Moreover, even with a relatively small amount of coating on paper, (the invention) was able to decrease methane generation. Microbial communities in anaerobic paper degradation were also influenced by the presence of (the invention) which might be associated with methane performance. The potential of (the invention) in methane reduction implies a possibility of putting this formula into industrial process and production."

The results of an experiment showing strong inhibition of methane formation by two concentrations of the invention are shown in FIG. 1. The high concentration of the invention repressed methane almost completely. The lower concentration reduced methane by about half.

BioLithe A

| Chemical Component | Concentration (g/L) | Mass Percentage of Component (%) |
|---|---|---|
| ferric ammonium citrate | 47.9 | 40.6 |
| Ferrous sulfate heptahydrate | 50 | 42.4 |
| manganese gluconate 14.4 g/ | 4.8 | 4.1 |
| Copper sulfate anhydrate | 2.5 | 2.1 |
| Zinc gluconate | 12.7 | 10.8 |
| Total | 117.9 | 100 |

BioLithe B

| Chemical Component | Concentration (g/L) | High Conc g/L | Low Conc g/L | Mass Percentage of Component (%) |
|---|---|---|---|---|
| Ferric ammonium citrate | 47.9 | 71.9 | 7.2 | 34.8 |
| Magnesium sulfate heptahydrate | 44.4 | 66.6 | 6.7 | 32.3 |
| Manganese gluconate | 9.6 | 14.4 | 1.4 | 7.0 |
| Copper sulfate anhydrate | 5 | 7.5 | 0.8 | 3.6 |
| Zinc gluconate | 30.6 | 45.9 | 4.6 | 22.3 |
| Adjust pH to 5.5 | | | | |
| Total | 137.5 | 206.3 | 20.6 | 100 |

BioLithe C

| Chemical Component | Concentration (g/L) | High Conc g/L | Low Conc g/L | Mass Percentage of Component (%) |
|---|---|---|---|---|
| Sodium chloride | 30.0 | 66.6 | 6.7 | 32.3 |
| Potassium chloride | 30.0 | 66.6 | 6.7 | 32.3 |
| Magnesium chloride | 18.0 | 39.9 | 4.0 | 19.4 |
| Ammonium chloride | 15 | 33.3 | 3.3 | 16.1 |
| Adjust pH to 5.5 | | | | |
| Total | 93 | 206.4 | 20.6 | 100 |

Preferred Solutions in ATA Tests.

Figure 2:
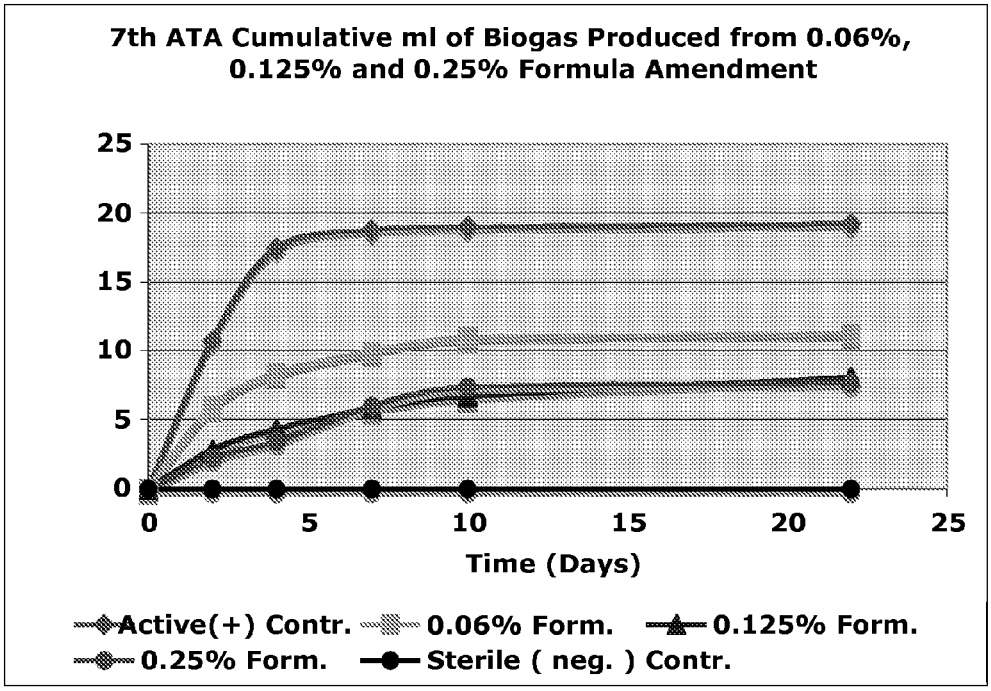
FIG. 2 is a chart showing reduction of biogas by three concentrations of the formula disclosed
Figure 3:
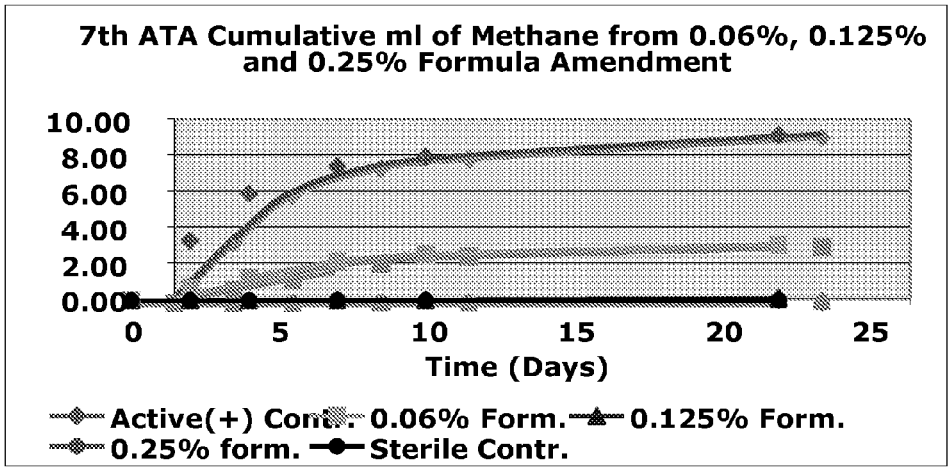
FIG. 3 is a chart of methane gas by different concentrations of the formulas disclosed.

Anaerobic toxicity assays (ATA) show whether tested compounds have the potential to interfere with anaerobic biodegradation processes. ATA tests at a leading research university showed that the invention strongly inhibited biogas (a marker for total biodegradation; essentially carbon dioxide plus methane) and methane formation (FIGS. 2 and 3, respectively).

The lowest concentration of the invention inhibited biogas (total biodegradation) by approximately 42%. Inhibition from the higher concentrations of the invention was around 58%, showing that some biodegradation was still occurring.

The invention inhibited methane to a much greater degree than carbon dioxide. The lowest concentration sample produced only one-third as much methane as the untreated sample. The higher concentrations of the invention nearly eliminated methane (FIG. 3) while still permitting some biodegradation (FIG. 2).

By use of the invention, methane can be nearly completely repressed, or partially inhibited, depending on the concentration of the invention used. Carbon dioxide can also be repressed, but to a lesser extent than methane, which is what would be expected if the invention discriminated against the methanogens by supplying nutrients to their competitors. The samples were not "poisoned"; some biodegradation still took place.

Methanogen Inhibitors.

Another component in the formulations can be chemicals which inhibit the growth of bacteria which produce methane. These are shown in the table below. Selected from this group, methanogenisis inhibitors would be added in the formulations for addition to paper production.

TABLE 1.2

Summary of studies that investigated specific methane inhibitors
Table from Chen (2010), of Methane inhibitors

| Inhibitor | System Investigated | Suppressive Concentration | Reference |
|---|---|---|---|
| Ethylene | Marine sediments | >5% v/v | Oremland and Taylor, 1975 |
| Methyl chloride | Landfill cover soil | >0.01% v/v | Chan and Parkin, 2000 |
| 2-Bromoethane sulfonic acid | Anaerobic digested sludge + activated sludge | 0.1-0.27 mM (potently inhibited) | Chae et al., 2010 |
| | | 50 mM (completely inhibited) | Parameswaran et al., 2009 |
| Thymol | Swine manure | 1.5/3.0 g/L | Varel and Wells, 2007 |

TABLE 1.2-continued

Summary of studies that investigated specific methane inhibitors
Table from Chen (2010), of Methane inhibitors

| Inhibitor | System Investigated | Suppressive Concentration | Reference |
|---|---|---|---|
| Nickel (Ni2+) | Anaerobic medium | 2.5 mM | Lorowitz et al., 1992 |
| Sodium | Anaerobic digester | >3,500 mg/L | Kugelman and McCarty, 1964 |
| Potassium | Anaerobic digester | >2,500 mg/L | Kugelman and McCarty, 1964 |
| Calcium | Anaerobic digester | >2,500 mg/L | Kugelman and McCarty, 1964 |
| Magnesium | Anaerobic digester | >1,000 mg/L | Kugelman and McCarty, 1964 |
| Copper (Cu2+) | Anaerobic digester | 10-250 mg/L | Sanchez et al., 1996 |
| Zinc (Zn2+) | Anaerobic digester | 10-250 mg/L | Sanchez et al., 1996 |
| Ferric iron (Fe3+) | Sewage sludge | 21 mg/L | Zhang et al., 2009 |

The salts listed are the ones which show the have the highest effect of interfering with methane output, including the ability to suppress it completely.

These chemicals have exhibited methane suppression effects, and combined with chemicals which encourage the growth of competing microbes, contribute to reducing methane production from cellulose in landfills. The middle-to-higher concentrations of the listed compounds should be capable of heavily to completely suppressing methane formation.

Use of the Product in Paper Making:

Since the earliest days of paper making, paper machine design has undergone continuing development, making it possible to make wider webs of paper, at ever increasing speeds, and to more exacting standards of quality. While the fundamental elements of most paper making machines has remained constant, operators of paper making machinery are constantly on the alert to find new methods of increasing the speeds of operation while simultaneously maintaining the same or similar quality standards.

Shortly after the development of the basic paper machine, a cylinder former was developed for use therewith. A cylinder former facilitated the manufacture of the first paperboards. In this regard, paperboards can be loosely defined as a stiff and thick paper. The line of demarcation between paper and paperboard is somewhat vague, but has been set by ISO at a grammage of approximately 224 grams per meter square. Therefore, material above 224 grams per meter square is termed board while lighter weights fall into the category of paper. While no standard has been set for caliper, the 224 gram per meter square basis weight corresponds roughly to a caliper of about 0.10 inches or "ten points". Paperboard can have a single ply or multi-ply structure; further, it can be manufactured on a single fourdrinier wire or on a series of formers of the same type or combination of types.

In the production of paper, a stock consisting of papermaking fibres, water and normally one or more additives is brought to the headbox of the paper machine. The headbox distributes the stock evenly across the width of the wire, so that a uniform paper web can be formed by dewatering, pressing and drying. The pH of the stock is important for the possibility to produce certain paper qualities and for the choice of additives.

Furnishing—Before the fiber furnish is carried to the paper machine, many noncellulose items are added to it. These additives fall into four categories:

1. internal sizing added to improve the liquid resistance of the paper
2. materials for loading and filling which improve optical and physical properties
3. dyestuffs and pigments to impart color to the paper
4. and additives for special characteristics.

The majority of these additives are introduced at the refiners/beaters, because that is the cheapest and easiest place. This allows for very uniform distribution, no special equipment is needed, and it is desirable to have the additives adsorbed into the fiber before bonding occurs.

Internal Sizing—There are two basic sizing principles. The first, internal sizing, consists of mixing the sizing agent, such as rosin, with the fibers and forming the mixture into a uniform distribution of fiber and sizing agents. The other method of sizing, surface sizing, consists of applying the sizing agent to the already formed sheets.

The ultimate purpose of sizing is to render the sheet more resistant to liquids. This could be ink or water, depending on the end-use requirement of the sheet. The most widely used internal sizing agent is rosin, a gummy substance that oozes from the cut surface of a pine tree. The paper industry classifies paper according to its sizing into three groups: unsized, weak-sized, and strong-sized papers. Unsized papers are called waterleaf; weak-sized papers, slack-sized; and strong-sized papers are known as hard sized. Blotting paper is an example of waterleaf, sized newsprint is one of slack-sized, and bond paper is a hard-sized paper.

Filling and Loading.

Filling and loading are different names for the same operation. Either name emphasizes a different aspect or function:

Filling—non-fibrous, mineral materials plug the spaces between fibers in a web of paper.

Loading—the same basis weight of a paper can be maintained by replacing some of its fiber content with non-fibrous materials that have a much higher specific gravity than cellulose fibers. (The specific gravity of fillers is between 2.6 and 4.5, that of cellulose fibers is 1.5.

Fillers, or loading materials, were originally considered adulterants used chiefly to cheapen the paper. It was not long, however, before they were recognized as serving perfectly legitimate purposes by increasing the opacity of the paper, aiding in obtaining a good finish on calendaring, and improving printing qualities by reducing "show-through" and "strike-through" of the ink. Today fillers are used in the great majority of printing papers. Clay is probably the oldest paper filler. It is also used as a coating pigment. Other fillers include calcium carbonate, barium sulfate, talc, diatomaceous earth, and the most opaque white pigment, titanium dioxide. The paper properties affected by fillers include opacity, brightness, smoothness, strength and ink receptivity.

Additives for Special Characteristics—Binders: The binders act in many different capacities, but their primary function is to increase the strength of the paper. Bursting, tensile, and folding strength are tremendously increased by the addition of binders. They also decrease surface fuzz and increase hardness and durability. Starch is the most important of these additives. The fiber-to-starch-to-fiber link is a stronger bond than is the fiber-to-fiber bond. The bonding increase promoted by starch is directly proportional to the inherent strength of the fiber type.

Although formulations of the invention may be added at any of the wet steps of paper making, adding a solution in the starch addition step has been found to be an effective way to add a non methanogen bacteria growth additive.

Following wet end operations which concludes with pressing, a sheet of paper, in the manufacturing process, is conveyed through a dryer section where residual water is removed by evaporation. On conventional paper machines, the thermal energy employed for evaporating the water out of the paper is made available by means of wrapping the paper around a series of large diameter, rotating, steam filled cylinders. By most estimates, the massive dryer section employed with conventional paper machines is the most expensive part of the paper machine in terms of capital cost. It is also the most costly to operate because of the high energy consumption associated with same. Therefore, efforts to increase the evaporation rate to reduce the number of dryers and conserve energy, thereby reducing steam usage, have heretofore been the focus of some attention by efficiency experts.

In the formation of paperboard such as what is utilized in milk cartons and similar products, the paperboard exiting the dryer section passes through a size press. In this regard, sizing operations are carried out primarily to provide the paperboard with resistance to penetration by aqueous solutions. Sizing operations also provides the paperboard with better surface characteristics, and, further, provides certain physical properties to the paperboard, such as surface strength and internal bond. In particular, surface sizing operations typically utilize starch particles to fill the surface voids in the paperboard thereby reducing pore radius and thus the rate of liquid penetration. Still further, there is another form of sizing, that is, internal sizing which utilizes rosin or other chemicals to reduce the rate of water penetration by affecting the contact angle.

Typically, surface sizing operations take place, most commonly, at a station which is located between dryer sections. The most common substance used in a surface sizing solution is starch, either cooked or in a modified form, that is, oxidized or enzyme converted. On occasion, wax emulsions or special resins are added to this solution. Other agents may also be used, as well, to provide specific strength and particular optical characteristics.

A formulation of the invention may be added to surface sizing operations, and thus be impregnated into the matrix of fibers in the paper.

Sizing solution is commonly applied to the multi-ply paper as it passes between a two-roll nip; hence the term "size press". Size presses come in various forms, including vertical, horizontal or inclined. In each case, however, the objective is to flood the entering nip with sizing solution. When this occurs, the paper passing through the nips absorb some of the solution and the balance is removed from the nip. The overflow solution is collected below the nip and recirculated back to the nip. The retention time of the multi-ply sheet in the pond and nip of the size press is very brief and consequently, the sizing operation must be carefully controlled to insure that the requisite amount of solids suspended in the sizing solution is absorbed uniformly across the multi-ply sheet. At the same time, the amount of water absorption should be minimized so that the steam requirement for subsequent drying is maintained at the lowest level. The main variables affecting the size press performance relate to the multi-ply sheet or paperboard characteristics; sizing solution composition; and design and operation of the size press. There are two basic mechanisms for incorporating starch solutions into the multi-ply sheet or paperboard at the size press. The first mechanism is the ability of the multi-ply sheet or paperboard to absorb the sizing solution; the second is the amount of sizing solution film passing through the nip, and the manner in which the paperboard and roll surfaces separate. Still further, other factors such as sheet moisture has a significant effect on the rate of sizing solution absorption.

Formulations sodium nitrate+potassium nitrate+magnesium nitrate hexahydrate

- sodium nitrate in the range 0.15 g/kg of paper to 2.5 g/kg paper, preferentially around 0.38 g/kg paper;
- potassium nitrate in the range of 0.06 g/kg paper to 1.25 g/kg paper, preferentially around 0.14 g/kg paper;
- magnesium nitrate hexahydrate in the range of 0.18 g/kg paper to 2.75 g/kg paper, preferentially around 0.4 g/kg paper sodium nitrate+potassium nitrate+magnesium nitrate hexahydrate+buffering agent(s) to bring solution to pH 5.5-6.0

- sodium nitrate in the range 0.15 g/kg of paper to 2.5 g/kg paper, preferentially around 0.38 g/kg paper;
- potassium nitrate in the range of 0.06 g/kg paper to 1.25 g/kg paper, preferentially around 0.14 g/kg paper;
- magnesium nitrate hexahydrate in the range of 0.18 g/kg paper to 2.75 g/kg paper, preferentially around 0.4 g/kg paper
- one or more buffering agents to bring the solution to a pH between 5.5 and 6.0 buffering agents contemplated include, but not limited to,
  - a mixture of acetate salt and acetic acid;
  - a mixture of monobasic and dibasic phosphate salts
  - a mixture of dibasic phosphate and citric acid
  - MES (2-(N-morpholino) ethanesulfonic acid)
- in concentrations necessary to keep the pH in the desired range Biolithe 8:
ferric ammonium citrate 71.9 g/L
magnesium sulfate 66.6 g/L
manganese gluconate 14.4 g/L
copper sulfate 7.5 g/L
zinc Gluconate 45.9 g/L
Biolithe C:
Sodium chloride 30 g/l
Potassium chloride 30 g/L
Calcium chloride 30 g/L
Magnesium chloride 18 g/L
Ammonium chloride 15 g/L

We claim:

1. A method of paper manufacture for reduction of methane production in discarded paper products, comprising the steps of:

- adding a nitrate salt to a suspension of cellolosic fibers in water during a wet portion of the paper making process, in which said nitrate salt comprises sodium nitrate in the range 0.15 g/kg of paper to 2.5 g/kg paper, potassium nitrate in the range of 0.06 g/kg paper to 1.25 g/kg paper, and magnesium nitrate hexahydrate in the range of 0.18 g/kg paper to 2.75 g/kg paper;
- dewatering and drying the cellulosic fibers to make paper, with nitrate salts in the fibers of the dried paper;
- producing paper impregnated with said nitrate salts, with said nitrate salts configured to promote the growth of denitrifying bacteria over growth of methane producing bacteria when said paper is digested in a land fill.

2. The method of claim 1 in which said nitrate salts are sodium nitrate at approximately 0.38 g/kg paper, potassium nitrate at approximately 0.14 g/kg paper, and magnesium nitrate hexahydrate at approximately 0.4 g/kg paper.

3. A method of paper manufacture for reduction of methane production in discarded paper products, comprising the steps of:

adding a nitrate salt comprising sodium nitrate in the range 0.15 g/kg of paper to 2.5 g/kg paper, potassium nitrate in the range of 0.06 g/kg paper to 1.25 g/kg paper, and magnesium nitrate hexahydrate in the range of 0.18 g/kg paper to 2.75 g/kg paper, to a suspension of cellulosic fibers in water during a wet portion of the paper making process;

adding a buffer to bring said suspension to a pH of 5.5 to 6.0a pH of dewatering and drying the cellulosic fibers to make paper, with nitrate salts in the fibers of the dried paper;

producing paper impregnated with said nitrate salts, with said nitrate salts configured to promote the growth of denitrifying bacteria over growth of methane producing bacteria when said paper is digested in a land fill.

4. The method of claim 3 in which said nitrate salts are sodium nitrate at approximately 0.38 g/kg paper, potassium nitrate at approximately 0.14 g/kg paper, and magnesium nitrate hexahydrate at approximately 0.4 g/kg paper.

* * * * *